US006918856B2

(12) United States Patent
Chang

(10) Patent No.: US 6,918,856 B2
(45) **Date of Patent: *Jul. 19, 2005**

(54) WAIST TWISTING MACHINE

(76) Inventor: Kuo-Yi Chang, No. 63, Lane 305, Sec. 3, Jungshan Rd., Tantz Shiang, Taichung County (TW) 427

( * ) Notice: Subject to any disclaimer, the term of this patent is extended or adjusted under 35 U.S.C. 154(b) by 35 days.

This patent is subject to a terminal disclaimer.

(21) Appl. No.: 10/629,790

(22) Filed: Jul. 30, 2003

(65) Prior Publication Data

US 2005/0026756 A1 Feb. 3, 2005

(51) Int. Cl.[7] ..... A63B 22/02
(52) U.S. Cl. ..... 482/51; 601/127; 601/131
(58) Field of Search ..... 482/51, 148, 54, 482/70; 601/133, 134, 143–145, 147, 127–128, 601/132; 446/236

(56) References Cited

U.S. PATENT DOCUMENTS 3,861,382 A * 1/1975 Simjian ..... 601/132
3,899,115 A * 8/1975 Simjian ..... 601/132
3,915,158 A * 10/1975 Simjian ..... 601/113
3,915,159 A * 10/1975 Simjian ..... 601/132
3,945,637 A * 3/1976 Simjian ..... 482/62
6,319,086 B1 * 11/2001 Shen ..... 446/236
6,533,635 B1 * 3/2003 Chern ..... 446/236
6,758,792 B1 * 7/2004 Chang ..... 482/54

* cited by examiner

*Primary Examiner*—Stephen R. Crow
(74) *Attorney, Agent, or Firm*—Troxell Law Office, PLLC

(57) ABSTRACT

A waist-twisting machine includes a main base, a rotating unit, an auxiliary base, and a hull unit. The main base has a first post, a fixing base, a power source, a gear unit and two press members. The rotating unit has a disc and a hoop deposited movably in the disc, which is rotated at its original location by two press members rotated by the gear unit driven by the power source. The hoop is moved by the disc in a circle of non-axial center with the disc, provided with numerous massage rollers in its inner surface so that a user entering the hoop may receive twisting action together with massage action synchronously, obtaining the effect of waist twisting and slimming at the same time.

6 Claims, 6 Drawing Sheets

WAIST TWISTING MACHINE

BACKGROUND OF THE INVENTION

1. Field of the Invention

This invention relates to a waist twisting machine, particularly to one automatically forcing a user to twist the waist regularly and also receive massage at the same time so as to slimming the body.

2. Description of the Prior Art

On the market many fitting machines are available for waist twisting, buttock swaying, breast expanding, weight lifting, jogging, etc. Hula-hoops are quite simple for twisting the waist of a user, possible to be rotated around the waist with soft smooth movement, so they are prevalent among consumers.

Although the hula-hoops are not expensive and simple to use, they have some disadvantages.

1. A user must have some experience or technique, or he/she cannot keep a hula-hoop rotate continuously without falling down the waist.

2. They are sized definite, not applicable for everyone.

3. At the beginning of rotating the hula-hoop, a user may be prone to hurt the waist, especially for the old.

4. A user has to focus on a hula-hoop in using, impossible to do other work.

5. During rotating a hula-hoop on the waist, it can only make massage to the waist with a point touching so its massage effect is quite trivial.

SUMMARY OF THE INVENTION

A main objective of the invention is to offer a waist twisting machine having a hoop adjustable in its location in a disc, and when the hoop is adjusted to have the same center with the disc, numerous massage rollers fixed on an inner surface of the hoop boy may make massage to the waist of a user positioning in the hoop, in addition to twisting the waist. Further, the user can adjust training mode and strength by controlling a panel.

A second objective of the invention is to offer a waist twisting machine, adjustable in the rotating speed of a hoop, along with in changing rotating direction, clockwise or counterclockwise, so as to let everyone receive the best training condition in using the machine by directly controlling the panel with conjunction of a computer.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
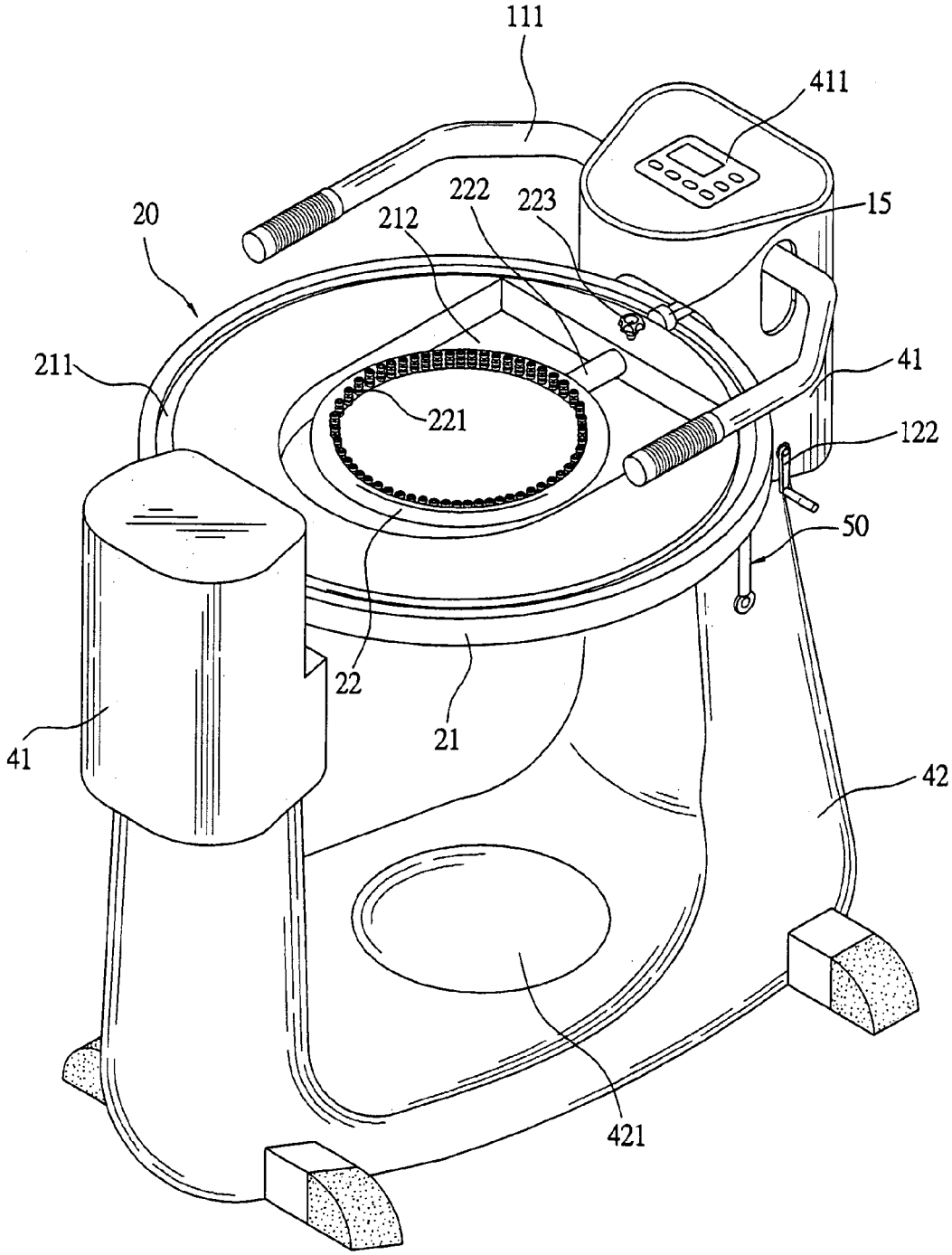
FIG. 1 is a perspective view of a waist-twisting machine in the present invention.
Figure 2:
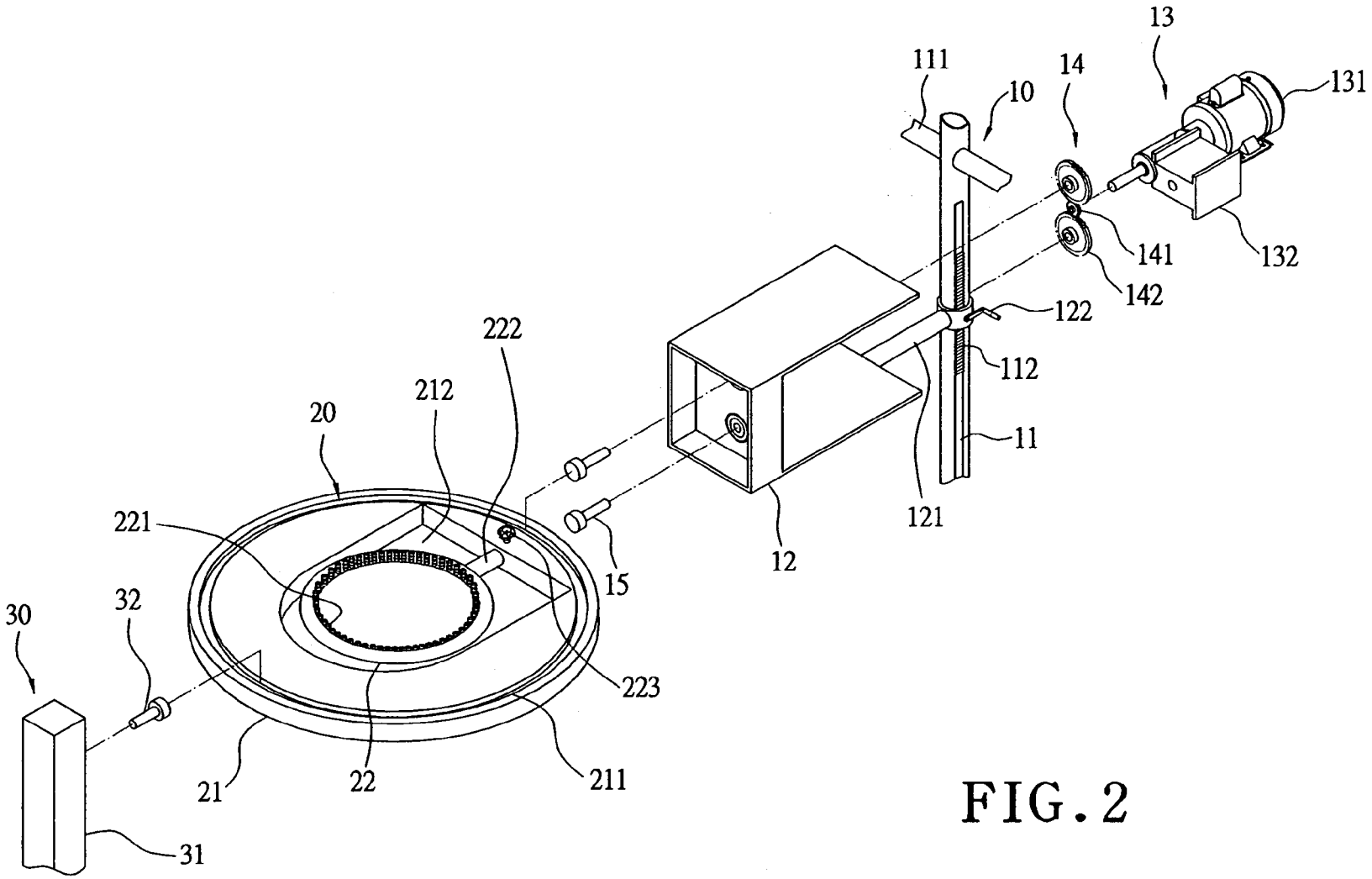
FIG. 2 is a partial exploded perspective view of the waist-twisting machine in the present invention.

A preferred embodiment of a waist twisting machine in the present invention, as shown in FIGS. 1 and 2, includes a main base 10, a rotating unit 20, an auxiliary base 30 and a hull unit 40 as main components combined together.

The main base 10 has a post 11, a fixing base 12, a power source 13, a gear unit 14 and two press members 15.

The post 11 is upright, having a grip 111 fixed at the upper end and extending to the right and the left side of the post 11.

The fixing base 12 has a horizontal support arm 121 extending rearward to movably combined with the post 11, and a rack 12 lengthwise. The support arm 121 has its rear end fitting around the post 11 and provided with a swing handle 122 engaging with the rack 112 to enable the support arm 121 move up and down along the post 11 by swinging the handle 122.

The power source 13 consists of a motor 131 and a speed-reducer 132 combined with the spindle of the motor 131, positioned in the fixing base 12.

The gear unit 14 consists of a main gear 141 and two subordinate gears 142 respectively engaging with the main gear 141, and the main gear 14 is connected with an output shaft of the speed-reducer 132. The two press members 15 are respectively connected with the two subordinate gears 142 to rotate together synchronously counterclockwise.

The rotating unit 20 consists of a disc 21 and a hoop 22, and the disc 22 has an annular groove 211 for the two press members 15 of the main base 10 to fit in and to rotate the disc 21 and an opening 212 formed in the center. The hoop 22 is shaped as a ring, having a open space in the center for the waist of a user to fit therein, and numerous massage rollers 221 fixed on an inner surface and a connect rod 222 fixed with an outer surface of the hoop 22 and having its outer end inserting movably in the wall defining the opening 212, with the hoop 22 is positioned in the opening 212. Then the connected rod 222 is locked stably with a fastener 223 in the wall of the opening 212, enabling the hoop 22 to be adjusted in its location in the opening 212.

The auxiliary base 30 has a second post 31 standing upright and a support pin 32 pivotally connected with the second post 31 at a preset location to fit in the annular groove 211 of the disc 21.

The hull unit 40 consists of two upper hulls 41 and a lower hull 42, and the two upper hulls 41 respectively surround an upper half of the main base 10 and the auxiliary base 30. The top end of the upper hull 41 of the main base 10 has a panel 411 controlling operation of the power source of the machine fixed thereon. As shown in FIG. 1, for the benefit of pressing for operating, the lower hull 42 surrounds the main base 10 and the lower half portion of the auxiliary base 30. Further, a standing platform 421 is formed between the bottom of the main base 10 and of the auxiliary base 30 for the two feet of a user to stand thereon.

Figure 3:
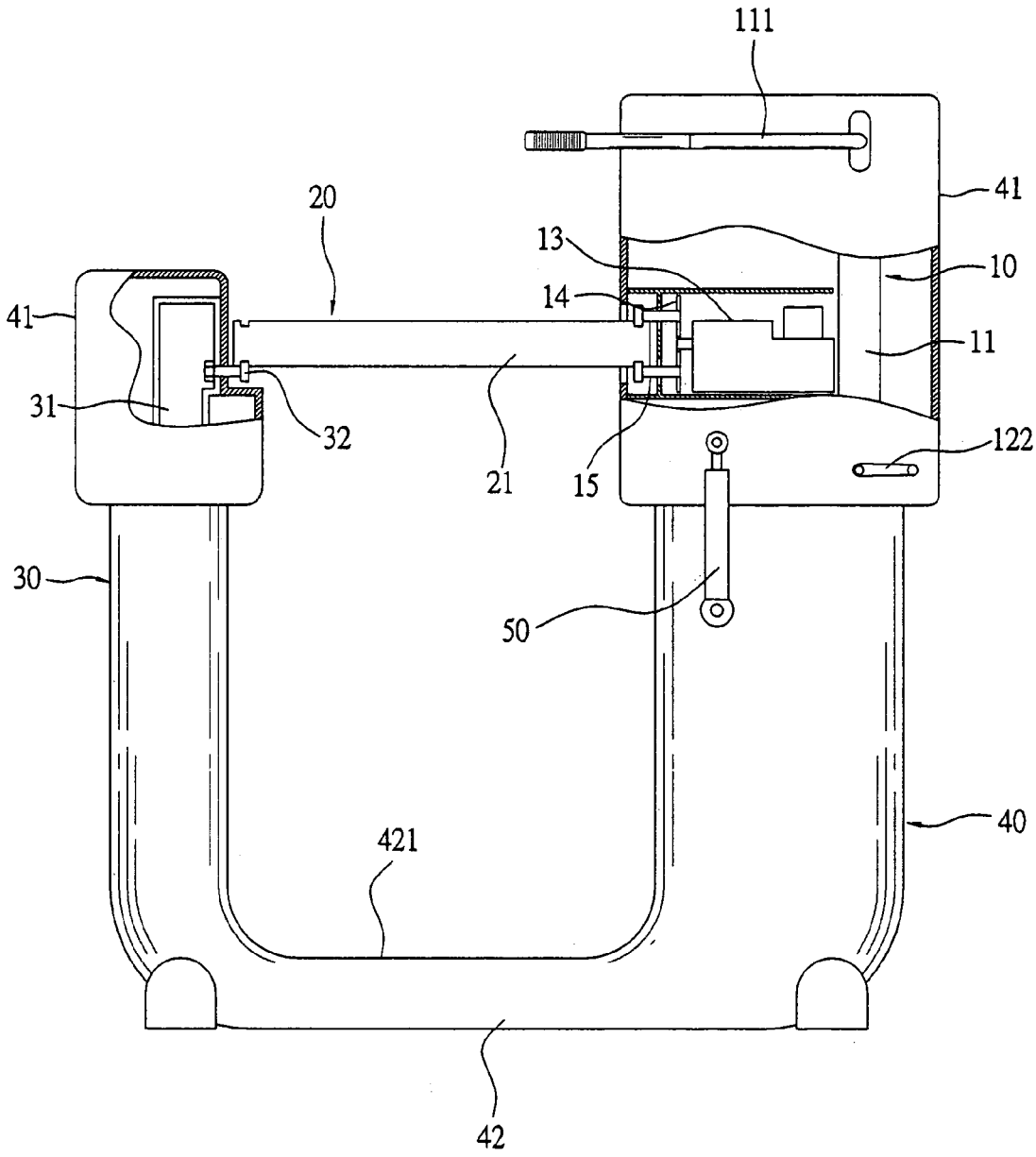
FIG. 3 is a side and partial cross-sectional view of the waist-twisting machine in the present invention.
Figure 4:
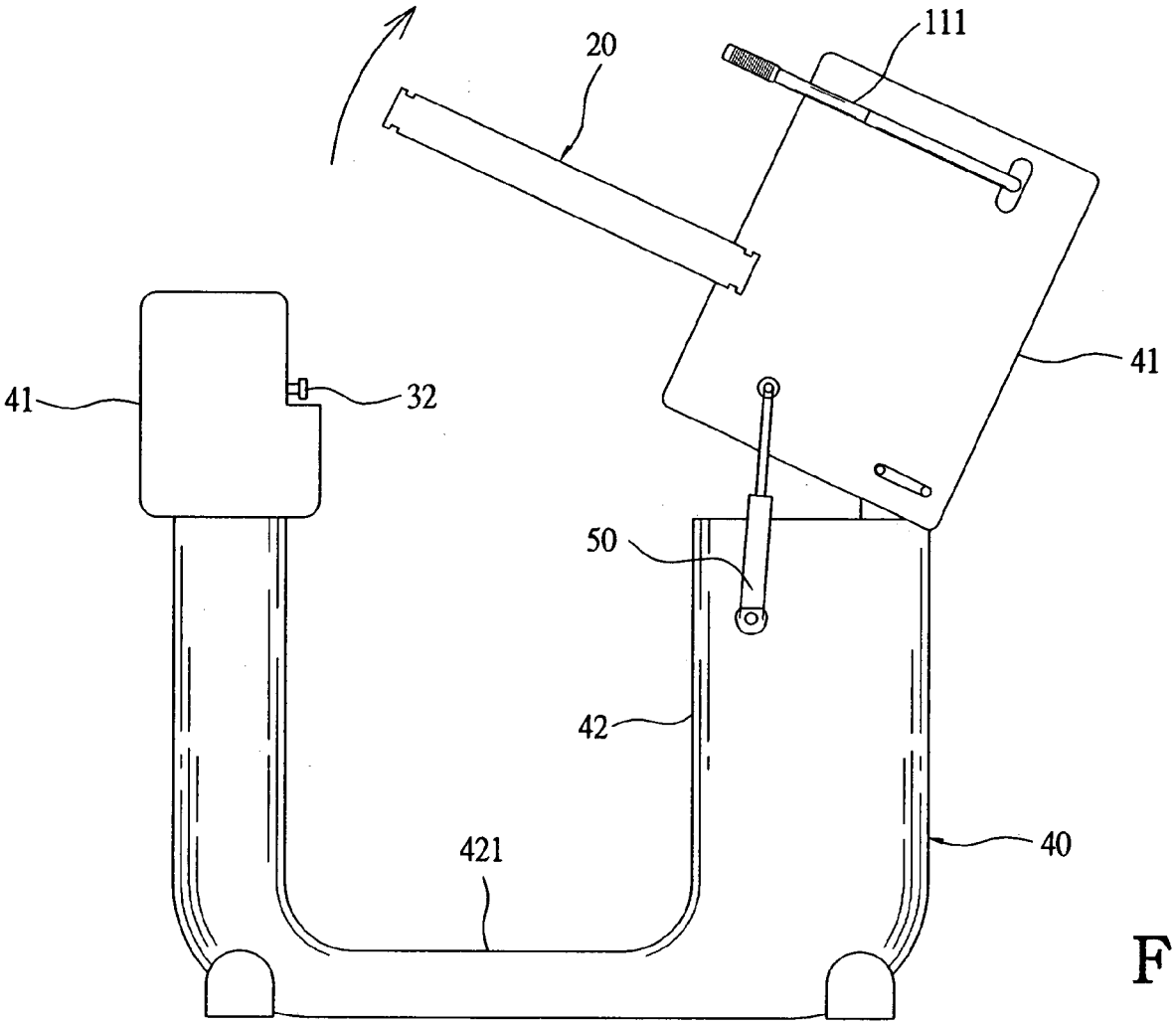
FIG. 4 is a side view of the waist-twisting machine with its rotating unit lifted up in the present invention.

Next, as shown in FIG. 3, the hoop 22 has a size a little larger than the waist of a user and also large enough for the shoulder of the user to pass through, so a user can move in the hoop 22 from under the disc 21. Or a pivotal rotating point (not shown) may be provided on the first post 11 of the main base 10 and some air or liquid pressure cylinders 50 provided pivotally between the upper hull 41 and the lower hull 42 to drive to lift the upper hull 41 together with the first post 11, the fixing base 12 and the rotating unit 20 to swing up, as shown in FIG. 4 to enable a user to enter the hoop 22 and then lowered down.

Figure 5:
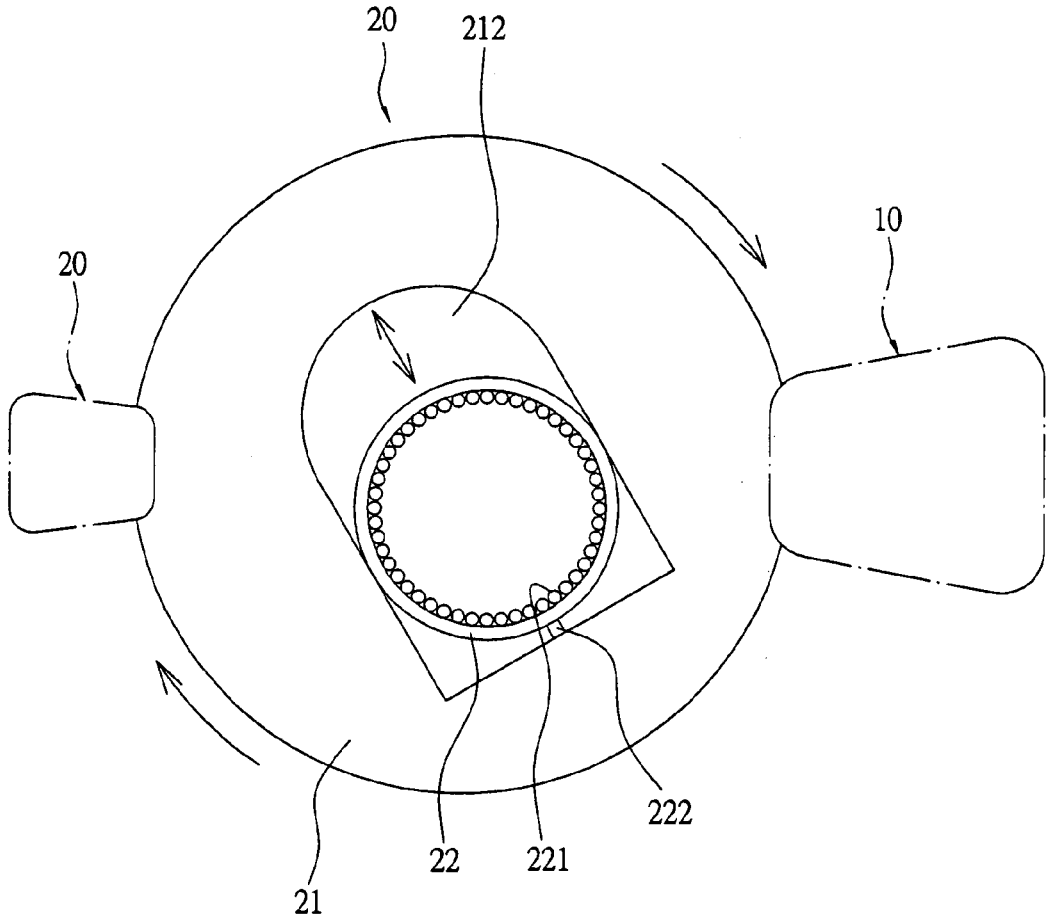
FIG. 5 is an upper view of a disc in rotation and a hoop body in sliding movement in the present invention; and, FIG. 6 is a side view of the waist-twisting machine in a using condition by a person in the present invention.
Figure 6:
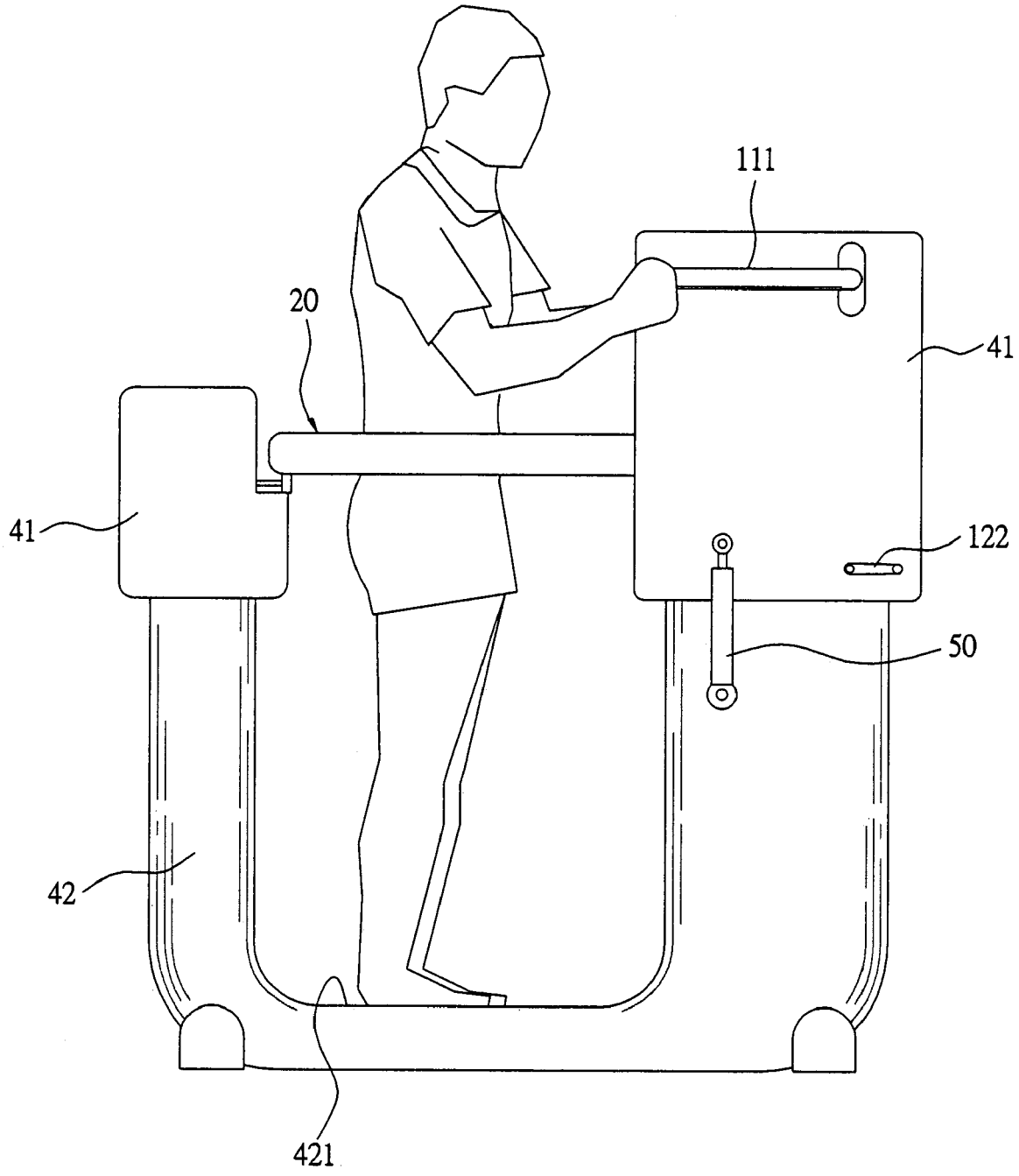

In using the waist twisting machine, referring to FIGS. 5 and 6, a user may directly enter the hoop 22 from under the disc 21 or lift the upper hull 41 as just described above, and then enters the hoop 22 and lowers it down, with the waist of the user positioned in the hoop 22. Then the user checks if the height of the waist is proper. If not, the user handles the swing handle 122 to adjust the height of the disc 21. Then the user controls the panel 411 to start the motor 131 and reduced in its speed by the speed-reducer 132 to increase torque, which is then transmitted to the gear unit 14 and then to the two press members 15, which then press the annular groove 211 of disc 21 and rotates the disc 21 at the same time. The hoop 22 is adjusted to the non-coaxial location with the disc 21. Then when the hoop 22 is rotated with the disc 21, the center of the hoop 22 may move in a circle so that the hoop 22 compels the user to twist the waist for the degree in the proportion to the distance between the two centers of the hoop 22 and the disc 21. So a user can adjust the twisting degree (or force) so as to suit to his/her own body size. At the same time, the massage rollers 221 can give massage action to the waist of the user incessantly during movement of the hoop 22

The invention has the following advantages, as can be seen from the foresaid description.

1. A user can have the waist receiving regular twisting action after entered the hoop, because of the circular motion of the disc, in addition to the arms holding the grips receiving like weight lifting effect at the same time.

2. The waist of the user can receive massage action by the massage rollers on the inner surface of the hoop during the circular motion of the disc, acquiring the effect of twisting and slimming at the same time.

3. To suit to one's own need, a user can choose the best speed of the motion of the disc driven by the motor with the speed-reducer possible to be adjusted by controlling the panel because of the rotating speed and its clockwise and counterclockwise rotation being controlled by the panel.

4. The hoop can be adjusted in its location in the disc, so when the hoop is adjusted to have the same co-axial center with the disc, the hoop only rotates at the same spot to have the waist receiving the massage action. But when the center of the hoop is moved outward farther away from that of the disc, the hoop will have its radius of the circular motion growing larger and larger, in other words, the degree (or force) of the twisting action to the waist of the user becomes larger and larger. So a user can select to adjust the degree of receiving twisting action according to his/her own need, whether the user is old or young.

While the preferred embodiment of the invention has been described above, it will be recognized and understood that various modifications may be made therein and the appended claims are intended to cover all such modifications that may fall within the spirit and scope of the invention.

What is claimed is:

1. A waist twisting machine comprising:

a main base having a first post, a fixing base, a power source, and a gear unit; said fixing base having a support arm extending rearward and movably connected with the first post, said power source fixed in said fixing base, said gear unit moved by said power source;

a rotating unit consisting of a disc and a hoop; said disc rotated at the original location by said gear unit driven by said power source, said disc having a center opening, said hoop positioned in said center opening and having a center space for the waist of a user to fit therein and numerous massage rollers fixed on an inner surface; and, said hoop moved in a circle like a hula hoop, the waist of a user standing in said hoop receiving regular twisting motion from said hoop after a user enters in the space of said hoop, the waist of the user also receiving massage action caused by said massage rollers fixed on the inner surface of said hoop at the same time so that the user can obtain the effect of waist twisting and slimming.

2. The waist twisting machine as claimed in claim 1, wherein a grip is further provided on an upper end of said first post and extends to the right and the left side of said first post, said first post has a rack in an intermediate portion lengthwise, said support arm has its outer end fitting around said first post, and a swing handle is fixed through the fitting-around member of the support arm and engages with said rack so as to enable said swing handle swing said support arm to move up and down along said first post.

3. The waist twisting machine as claimed in claim 1, wherein said hoop has a connected rod fixed at an outer surface, said connect rod has its outer end extending movably in an wall defining said center opening of said disc, and said outer end of said connect rod can be locked by a fastening means so as to move in and out of said connect rod and accordingly also said hoop.

4. The waist twisting machine as claimed in claim 1, wherein said power source consists of a motor and a speed-reducer, said gear unit consists of a main gear and two subordinate gears, with said main gear connected with an output shaft of said speed-reducer, and with said two subordinate gears respectively engaging with said main gear and respectively connected with a press member, said two press members rotate counterclockwise as said two subordinate gears, said disc has an annular groove in an upper and a lower surface near an outer circumference, and said two press members fits in said annular groove to pressingly rotate said disc at its original location.

5. The waist twisting machine as claimed in claim 1, wherein an auxiliary base is further provided in front of said main base to match with, said auxiliary base has a second post, and a support member, said support member is pivotally provided at a proper location of said second post, having its outer end fitting in the lower annular groove of said disc to support said disc horizontally.

6. The waist twisting machine as claimed in claim 1, wherein a hull respectively surrounds said main base and said auxiliary base, and a control panel is fixed on an upper end of said hull for said main base, and a standing platform is formed between the bottoms of the two hulls.

* * * * *